US011221003B2

(12) United States Patent
Sung et al.

(10) Patent No.: US 11,221,003 B2
(45) Date of Patent: Jan. 11, 2022

(54) CONTROL VALVE FOR A SWASH PLATE COMPRESSOR HAVING A PASSAGE CONTROLLED BY THREE ORIFICE HOLES AND VARIABLE CAPACITY COMPRESSOR

(71) Applicant: Hanon Systems, Daejeon (KR)

(72) Inventors: Yeol Woo Sung, Daejeon (KR); Se Young Song, Daejeon (KR)

(73) Assignee: Hanon Systems, Daejeon (KR)

( * ) Notice: Subject to any disclaimer, the term of this patent is extended or adjusted under 35 U.S.C. 154(b) by 99 days.

(21) Appl. No.: 16/613,464

(22) PCT Filed: May 28, 2018

(86) PCT No.: PCT/KR2018/006009
§ 371 (c)(1),
(2) Date: Nov. 14, 2019

(87) PCT Pub. No.: WO2018/221902
PCT Pub. Date: Dec. 6, 2018

(65) Prior Publication Data

US 2020/0400133 A1 Dec. 24, 2020

(30) Foreign Application Priority Data

May 30, 2017 (KR) ..... 10-2017-0067010

(51) Int. Cl.
*F04B 27/18* (2006.01)
*F04B 27/10* (2006.01)
*F04B 27/08* (2006.01)

(52) U.S. Cl.
CPC ..... *F04B 27/18* (2013.01); *F04B 27/08* (2013.01); *F04B 27/10* (2013.01); *F04B 2027/185* (2013.01); *F04B 2027/1827* (2013.01)

(58) Field of Classification Search
CPC .... F04B 27/18; F04B 2027/185; F04B 27/16; F04B 27/08; F04B 2027/1836; F04B 27/24; F04B 2207/01
See application file for complete search history.

(56) References Cited

U.S. PATENT DOCUMENTS 6,280,152 B1 * 8/2001 Sugiura ..... F04B 27/0891 417/222.2
2005/0053474 A1 * 3/2005 Hirota ..... F04B 27/1804 417/222.2

(Continued)

FOREIGN PATENT DOCUMENTS

JP H06-123279 A 5/1994
JP 2000297746 A 10/2000

(Continued)

OTHER PUBLICATIONS

International Search Report issued in PCT/KR2018/006009 dated Sep. 17, 2018.

*Primary Examiner* — Nathan C Zollinger
*Assistant Examiner* — Timothy P Solak
(74) *Attorney, Agent, or Firm* — Norton Rose Fulbright US LLP; James R. Crawford

(57) ABSTRACT

A control valve and a variable capacity compressor having a control valve or a passage connecting the control valve and a crank chamber. A fixed orifice hole is variable which is possible by selectively opening and closing a plurality of holes depending on the operation of the compressor.

8 Claims, 9 Drawing Sheets

(56) References Cited

U.S. PATENT DOCUMENTS

| | | | | |
|---|---|---|---|---|
| 2009/0123300 | A1* | 5/2009 | Uibel | F04B 27/1804 417/213 |
| 2009/0283164 | A1* | 11/2009 | Cho | F04B 27/1804 137/624.27 |
| 2012/0056113 | A1* | 3/2012 | Tano | F04B 27/1804 251/25 |
| 2012/0198992 | A1* | 8/2012 | Futakuchi | F04B 27/1804 91/505 |
| 2015/0345655 | A1* | 12/2015 | Higashidozono | F04B 27/1804 137/624.27 |

FOREIGN PATENT DOCUMENTS

| | | | |
|---|---|---|---|
| JP | 2004-116349 | A | 4/2004 |
| KR | 20050094868 | A | 9/2005 |
| KR | 20120024478 | A | 3/2012 |
| KR | 20120100189 | A | 9/2012 |
| KR | 20140021180 | A | 2/2014 |

* cited by examiner

CONTROL VALVE FOR A SWASH PLATE COMPRESSOR HAVING A PASSAGE CONTROLLED BY THREE ORIFICE HOLES AND VARIABLE CAPACITY COMPRESSOR

This application is a national phase under 35 U.S.C. § 371 of International Application No. PCT/KR2018/006009 filed May 28, 2018, which claims the benefit of priority from Korean Patent Application No. 10-2017-0067010 filed on May 30, 2017. The entire contents of each of these applications is incorporated herein by reference in its entirety.

TECHNICAL FIELD

The present disclosure relates to a control valve and a variable capacity compressor, and more particularly, to a control valve and a variable capacity compressor which are capable of preventing an unnecessary loss of control gas to improve efficiency of the compressor.

BACKGROUND ART

In general, a compressor applied to air conditioning systems sucks refrigerant gas having passed through an evaporator to compress it to high temperature and high pressure, and then discharges the compressed refrigerant gas to a condenser. There are used various types of compressors such as a reciprocating compressor, a rotary compressor, a scroll compressor, and a swash plate compressor.

Among these compressors, the compressor using an electric motor as a power source is typically referred to as an electric compressor, and the swash plate compressor is widely used in air conditioning systems for vehicles.

The swash plate compressor includes a disk-shaped swash plate that is obliquely installed to a drive shaft, rotated by the power transmitted from an engine, to be rotated by the drive shaft. The principle of the swash plate compressor is to suck or compress and discharge refrigerant gas by rectilinearly reciprocating a plurality of pistons within cylinders along with the rotation of the swash plate. In particular, the variable capacity swash plate compressor disclosed in Korean Patent Application Publication No. 2012-0100189 includes a swash plate, the angle of inclination of which is varied by adjusting the pressure in a crank chamber, and is configured such that the movement distance of a piston is changed as the angle of inclination of the swash plate is varied, thereby regulating the discharge rate of refrigerant.

In the variable capacity swash plate compressor, a passage is defined through a fixed orifice hole such that the compressor is variably operable by discharging the refrigerant gas in the crank chamber to a suction chamber. The fixed orifice hole is generally formed in the valve plate of the variable capacity swash plate compressor, which is large in size due to the limited machinability of the valve plate. Hence, the refrigerant in the crank chamber excessively leaks into the suction chamber, and an inefficient stroke is continuously performed such as continuous introduction of high-pressure refrigerant into the crank chamber from the discharge chamber in order to supplement the leakage of refrigerant.

Accordingly, there is a need for methods to resolve these issues.

DISCLOSURE

Technical Problem

It is an object of the present disclosure to a control valve and a variable capacity compressor which are capable of preventing an unnecessary loss of control gas to improve efficiency of the compressor.

Technical Solution

To accomplish the above-mentioned object, in accordance with an aspect of the present disclosure, there is provided a control valve (700) to adjust an angle of a swash plate (500) of a variable capacity compressor. The control valve (700) includes a valve housing (710) having a first hole (712) in communication with a discharge chamber (320) of the compressor, a second hole (714) in communication with a crank chamber (250), and a third hole (716) in communication with a suction chamber (310), a first passage allowing the first hole (712) to communicate with the second hole (714) and a second passage allowing the second hole (714) to communicate with the third hole (716) in the valve housing (710), a first switching means for opening and closing the first passage, and a second switching means for opening and closing the second passage, wherein the first passage is fully opened and the second passage is partially opened in a first condition in which an angle of inclination of the swash plate (500) is decreased to minimize a movement distance of a piston (112), and the first passage is fully closed and the second passage is fully opened in a second condition in which the angle of inclination of the swash plate (500) is increased to maximize the movement distance of the piston (112).

In a third condition in which the angle of the swash plate (500) is adjusted so that the movement distance of the piston (112) corresponds between the first condition and the second condition, the first passage may be partially opened and the second passage may be opened to a degree that is larger than the partial opening and smaller than the full opening.

The second switching means may open the second passage larger in the order of the first condition<the third condition<the second condition.

The second switching means may include first to third orifice holes for individually opening and closing the second passage, and in the first condition, the second orifice hole may allow the second passage to be opened, and the other first and third orifice holes may allow the second passage to be closed.

In the second condition, the first to third orifice holes may allow the second passage to be opened.

In the third condition, the first and second orifice holes may allow the second passage to be opened, and the third orifice hole may allow the second passage to be closed.

The first switching means may be a ball valve that comes into contact with or is separated from the valve housing (710) between the first hole (712) and the second hole (714) to open and close the first passage.

In accordance with another aspect of the present disclosure, there is provided a variable capacity compressor that includes the control valve (700) according to the above aspect, the crank chamber (250) having the swash plate (500) disposed therein, a cylinder bore (110) in which the piston (112) reciprocates to compress a refrigerant, and a valve assembly (600) configured to suck or discharge the refrigerant into or from the cylinder bore (110), wherein the valve assembly (600) includes a valve plate only having a suction hole for circulation of the refrigerant sucked thereinto, a discharge hole for circulation of the refrigerant discharged therefrom, and first to third circulation holes for connecting the control valve (700) to the suction chamber (310), the discharge chamber (320), and the crank chamber (250), a suction reed disposed on one surface of the valve plate to open and close the suction hole, and a discharge reed disposed on the other surface of the plate to open and close the discharge hole.

In accordance with still another aspect of the present disclosure, there is provided a variable capacity compressor that includes the control valve (700) according to above aspect, the crank chamber (250) having the swash plate (500) disposed therein, a cylinder bore (110) in which the piston (112) reciprocates to compress a refrigerant, and a valve assembly (600) configured to suck or discharge the refrigerant into or from the cylinder bore (110), wherein the valve assembly (600) includes a valve plate only having a suction hole for circulation of the refrigerant sucked thereinto, a discharge hole for circulation of the refrigerant discharged therefrom, first to third circulation holes for connecting the control valve (700) to the suction chamber (310), the discharge chamber (320), and the crank chamber (250), and an assembly hole for housing fastening, a suction reed disposed on one surface of the valve plate to open and close the suction hole, and a discharge reed disposed on the other surface of the plate to open and close the discharge hole.

In accordance with yet another aspect of the present disclosure, there is provided a variable capacity compressor that includes the control valve (700) according to above aspect, the crank chamber (250) having the swash plate (500) disposed therein, a cylinder bore (110) in which the piston (112) reciprocates to compress a refrigerant, and a valve assembly (600) configured to suck or discharge the refrigerant into or from the cylinder bore (110), wherein the valve assembly (600) includes a valve plate only having a suction hole for circulation of the refrigerant sucked thereinto, a discharge hole for circulation of the refrigerant discharged therefrom, first to third circulation holes for connecting the control valve (700) to the suction chamber (310), the discharge chamber (320), and the crank chamber (250), an assembly hole for housing fastening, and a coupling hole for coupling a discharge reed, a suction reed disposed on one surface of the valve plate to open and close the suction hole, and the discharge reed disposed on the other surface of the plate to open and close the discharge hole.

In accordance with a further aspect of the present disclosure, there is provided a variable capacity compressor that includes a crank chamber (250) having a swash plate (500) disposed therein, a piston (112) connected to the swash plate (500), a cylinder bore (110) into which the piston (112) is inserted, a refrigerant being sucked into the cylinder bore, compressed therein, and then discharged therefrom, a suction chamber (310) for providing the refrigerant transmitted from the outside to the cylinder bore (110), a discharge chamber (320) for transmitting the refrigerant discharged from the cylinder bore (110) to the outside, a control valve (700) connected to the crank chamber (250), the suction chamber (310), and the discharge chamber (320) to adjust an angle of the swash plate (500), and an orifice hole formed in a passage connecting the control valve (700) and the crank chamber (250) to connect the crank chamber (250) and the suction chamber (310).

The variable capacity compressor may further include a valve assembly (600) disposed between the cylinder bore (110), the suction chamber (310), and the discharge chamber (320) to circulate the refrigerant.

The valve assembly (600) may include a valve plate only having a suction hole for flow of the refrigerant from the suction chamber (310) to the cylinder bore (110), a discharge hole for flow of the refrigerant from the cylinder bore (110) to the discharge chamber (320), and first to third circulation holes for connecting the control valve (700) to the suction chamber (310), the discharge chamber (320), and the crank chamber (250), a suction reed disposed on one surface of the valve plate to open and close the suction hole, and a discharge reed disposed on the other surface of the plate to open and close the discharge hole.

The valve assembly (600) may include a valve plate only having a suction hole for flow of the refrigerant from the suction chamber (310) to the cylinder bore (110), a discharge hole for flow of the refrigerant from the cylinder bore (110) to the discharge chamber (320), first to third circulation holes for connecting the control valve (700) to the suction chamber (310), the discharge chamber (320), and the crank chamber (250), and an assembly hole for housing fastening, a suction reed disposed on one surface of the valve plate to open and close the suction hole, and a discharge reed disposed on the other surface of the plate to open and close the discharge hole.

The valve assembly (600) may include a valve plate only having a suction hole for flow of the refrigerant from the suction chamber (310) to the cylinder bore (110), a discharge hole for flow of the refrigerant from the cylinder bore (110) to the discharge chamber (320), first to third circulation holes for connecting the control valve (700) to the suction chamber (310), the discharge chamber (320), and the crank chamber (250), an assembly hole for housing fastening, and a coupling hole for coupling a discharge reed, a suction reed disposed on one surface of the valve plate to open and close the suction hole, and the discharge reed disposed on the other surface of the plate to open and close the discharge hole.

Advantageous Effects

A variable capacity compressor according to exemplary embodiments of the present disclosure can reduce a loss of control gas by eliminating a fixed orifice hole formed in an existing valve assembly and forming it in a control valve or a passage connecting the control valve and a crank chamber. In this case, forming the fixed orifice hole in the control valve is advantageous in that the size of the fixed orifice hole is variable (which is possible by selectively opening and closing a plurality of holes) depending on the operation of the compressor. On the other hand, forming the fixed orifice hole in the passage connecting the control valve and the crank chamber causes the loss of control gas to be reduced because the fixed orifice hole can be machined to a smaller size compared to an existing orifice hole, the minimum size of which is limited due to difficulty of machining.

DESCRIPTION OF DRAWINGS

FIG. 10 is a front view of a valve plate according to the invention.

BEST MODE

Hereinafter, a swash plate compressor according to exemplary embodiments of the present disclosure will be described in detail with reference to the accompanying drawings (in the present disclosure, the refrigerant gas flowing in a compressor will be referred to as gas, refrigerant gas, etc., and the refrigerant gas flowing into a control valve will be separately referred to as control gas since it is a control concept).

Figure 1:
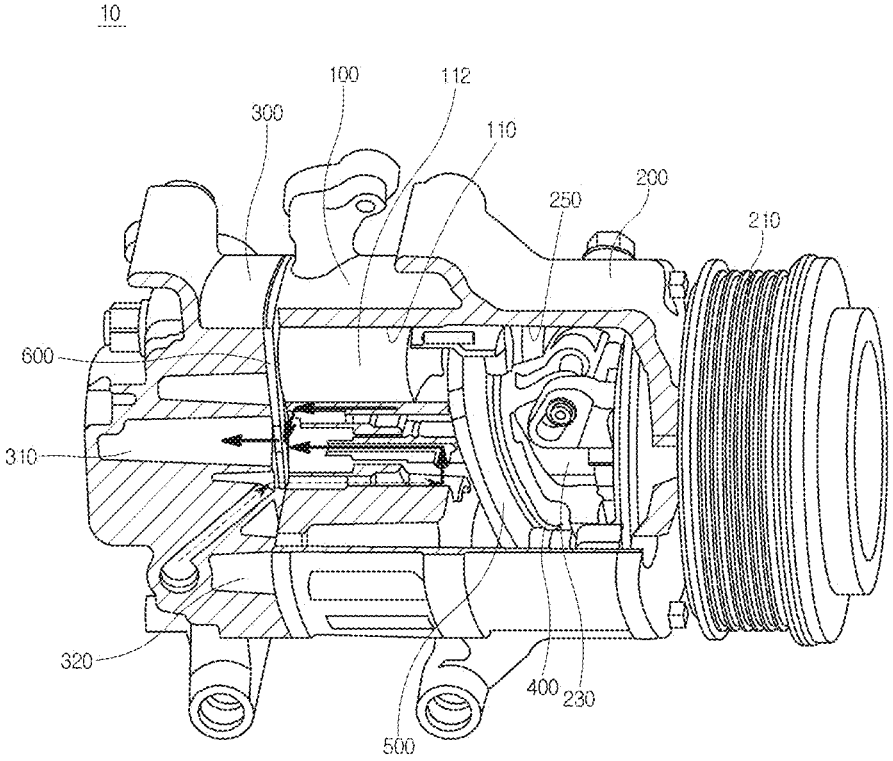
FIG. 1 is a partial perspective view schematically illustrating a typical swash plate compressor.
Figure 1:
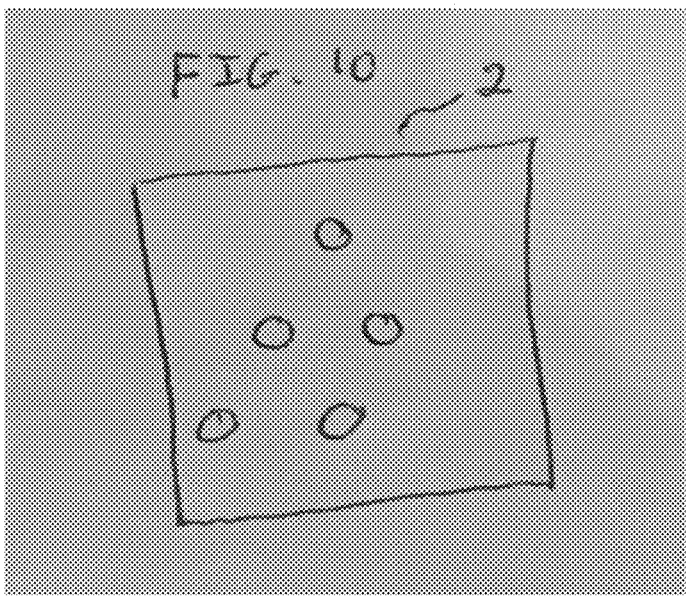

FIG. 1 is a partial perspective view schematically illustrating a typical swash plate compressor. The basic configuration of the compressor will be described with reference to FIG. 1, and the basic configuration of the compressor except for the main configuration of the present disclosure refers to FIG. 1 but is not limited thereto.

As illustrated in FIG. 1, a variable capacity swash plate compressor 10 includes a substantially cylindrical main housing 100, a front housing 200 coupled to the front of the main housing 100, a rear housing 300 coupled to the rear of the main housing 100, and a drive unit provided inside them.

The main housing 100 is provided therein with a cylinder block having a plurality of cylinder bores 110, and a piston 112 is inserted into each of the cylinder bores. The drive unit is disposed in the front housing 200, and a suction chamber 310 and a discharge chamber (not illustrated in FIG. 1) are disposed in the rear housing 300.

The drive unit includes a drive shaft 230 coupled with a pulley 210, which receives power from an engine, to rotate along therewith, and a rotor 400 and a swash plate 500, which are coupled on the drive shaft 230. The drive shaft 230 is installed over the front housing 200 and the main housing 100, and the rotor 400 and the swash plate 500 are disposed in the front housing 200.

The piston 112 is connected to the swash plate 500 that is driven with an inclination at a certain angle with respect to the drive shaft 230, and rectilinearly reciprocates to move back and forth longitudinally in the cylinder bore 110 by the driving of the swash plate 500. Refrigerant gas is compressed by the reciprocation of the piston 112.

The space in which the rotor 400 and the swash plate 500 are accommodated in the front housing 200 is called a control chamber or a crank chamber 250, and the angle of inclination of the swash plate 500 is varied by adjusting the pressure in the crank chamber 250. In more detail, the angle of inclination of the swash plate 500 is adjusted by changing the differential pressure between the suction chamber 310 and the crank chamber 250, thereby regulating the discharge rate and pressure of refrigerant.

The rear housing 300 includes the suction chamber 310 in which the refrigerant gas sucked into the piston 112 is accommodated, the discharge chamber 320 from which the refrigerant compressed by the piston 112 is discharged, and a control valve (not illustrated in FIG. 1). A valve assembly 600 is provided between the rear housing 300 and the main housing 100 to open and close a passage for refrigerant gas, communicating with the suction chamber 310 and the discharge chamber, during suction and discharge of the refrigerant gas. To this end, a valve plate 2 is provided with a suction reed and a discharge reed, but unlike the related art, it is not provided with a fixed orifice hole for the pass of control gas. The present disclosure proposes a structure that minimizes a loss of control gas by eliminating the fixed orifice hole typically provided in the valve plate and applying an orifice structure to the rear housing 300 and the control valve.

The refrigerant gas in the suction chamber 310 is introduced into the cylinder bore 110, and the refrigerant gas compressed by the piston 112 is discharged to the discharge chamber 320. A first passage (indicated by the dotted line in FIG. 2) leading to the crank chamber 250 via the discharge chamber 320 and the control valve, and a second passage (indicated by the solid line in FIG. 2) leading to the suction chamber 310 from the crank chamber 250 are passages controlled by the control valve.

When a cooling load is small, the pressure in the crank chamber 250 is controlled to increase by the control valve, in which case the angle of inclination of the swash plate 500 is also reduced so that the swash plate 500 becomes perpendicular to the drive shaft 230. When the angle of inclination of the swash plate 500 is reduced, the movement distance of the piston is also decreased so that the discharge rate of refrigerant is reduced (first condition).

On the other hand, when a cooling load is large, the pressure in the crank chamber 250 is controlled to decrease by the control valve, in which case the angle of inclination of the swash plate 500 is also increased. When the angle of inclination of the swash plate 500 is increased, the movement distance of the piston is also increased so that the discharge rate of refrigerant is increased (second condition).

When the angle of inclination of the swash plate 500 is adjusted so that the movement distance of the piston corresponds between the first condition and the second condition (third condition), the discharge rate of refrigerant is also adjusted between the first condition and the second condition.

At the time of the initial operation of the compressor or to maximize the movement distance of the piston by increasing the angle of inclination of the swash plate 500, the pressure in the crank chamber 250 must be lowered as much as possible. To this end, the high-pressure control gas in the crank chamber 250 must quickly flow out into the suction chamber 310. In the related art, the orifice holes are provided in the control valve (for opening the passage connecting the crank chamber and the suction chamber) and the valve plate so that the refrigerant gas in the crank chamber 250 flows out into the suction chamber 310. However, in the present disclosure, the control gas flows out into the suction chamber 310 only through the control valve. In addition, in the present disclosure, a variable orifice (which will be described later) is formed in the control valve 700 to be opened as much as possible when maximum discharge is required, with the consequence that the control gas in the crank chamber 250 may flow to the suction chamber 310 within a short time.

On the other hand, to reduce the movement distance of the piston by decreasing the angle of inclination of the swash plate 500, the crank chamber 250 must be quickly filled with the control gas. In order to quickly fill the crank chamber 250 with the control gas, the variable orifice formed in the control valve 700 is narrowed to minimize the amount of the control gas discharged from the crank chamber 250. In addition, the crank chamber 250 may be filled with the control gas more quickly because there is no existing fixed orifice or the size of the orifice is smaller than that of the existing orifice.

In the swash plate compressor having the above configuration, a passage and an orifice structure in which the refrigerant gas flows according to the present disclosure will be described in detail.

Figure 2:
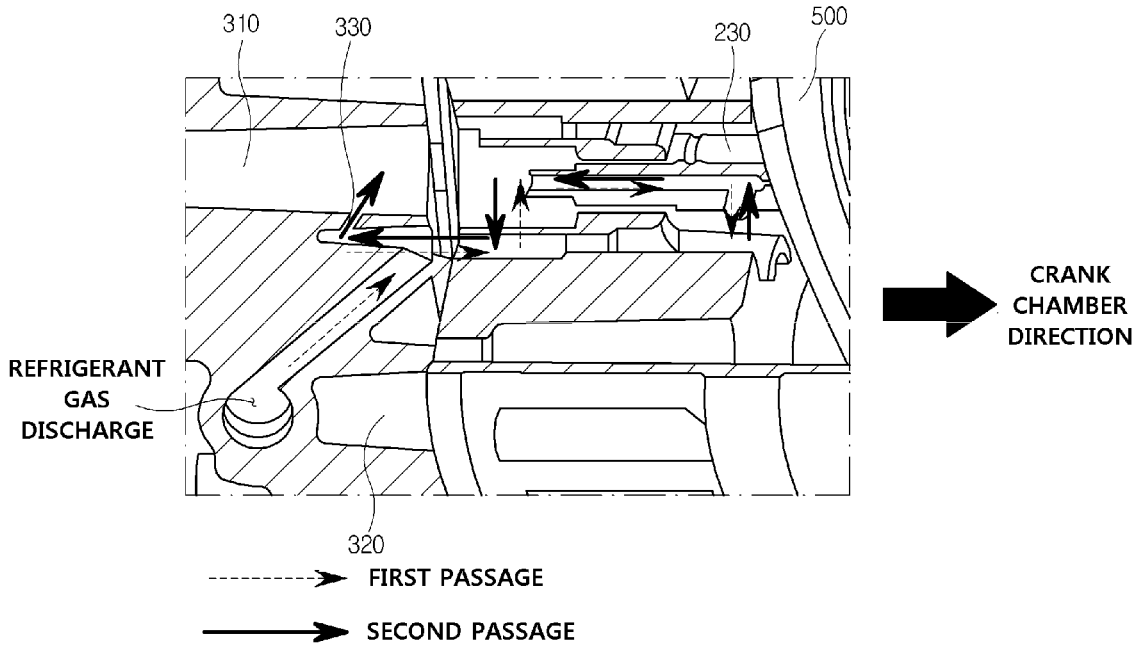
FIG. 2 is a partial cross-sectional view illustrating an example of a passage and a fixed orifice hole in a variable capacity compressor according to the present disclosure.
Figure 3:
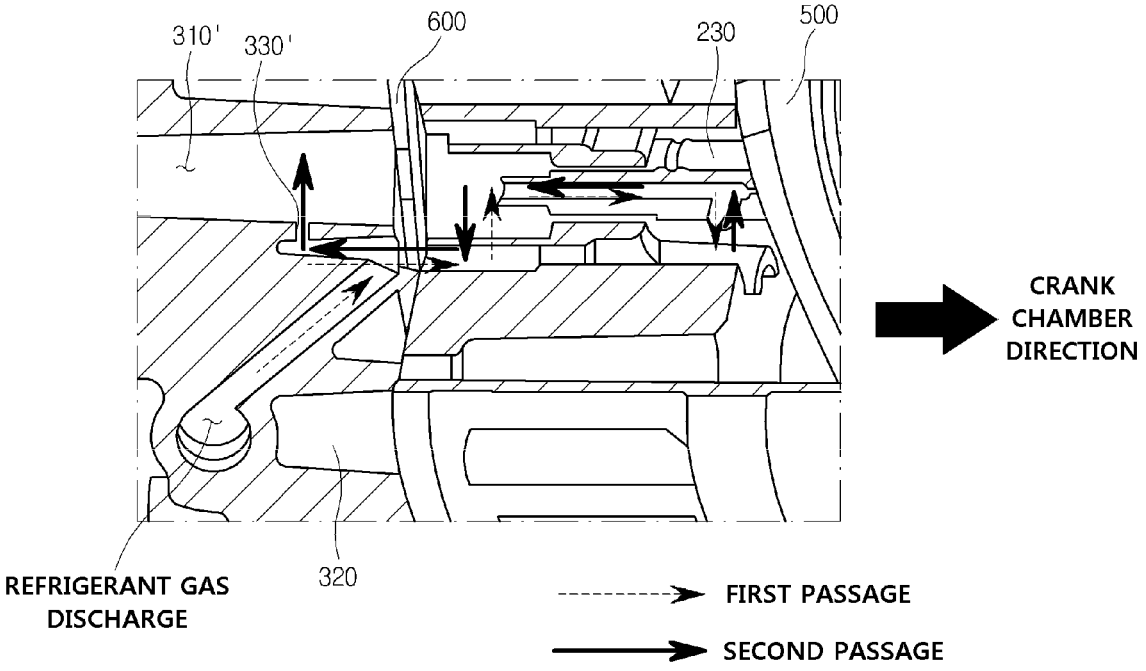
FIG. 3 is a partial cross-sectional view illustrating another example of a passage and a fixed orifice hole in the variable capacity compressor according to the present disclosure.

FIG. 2 is a partial cross-sectional view illustrating an example of a passage and a fixed orifice hole in the variable capacity compressor according to the present disclosure. FIG. 3 is a partial cross-sectional view illustrating another example of a passage and a fixed orifice hole in the variable capacity compressor according to the present disclosure (herein, the first passage is indicated by the dotted line and the second passage is indicated by the solid line).

As illustrated in FIG. 2, in order to supply the refrigerant gas to the crank chamber 250, the refrigerant gas is introduced from a discharge chamber communication hole Pd communicating with the discharge chamber 320 and flows to the crank chamber 250 along the first passage.

On the other hand, in order to discharge the refrigerant gas from the crank chamber 250, the refrigerant gas is introduced into the cylinder bore 110 along the second passage which is the same path as the first passage. The refrigerant gas flows to the rear housing 300 through the suction reed of the valve plate, and is discharged to the suction chamber 310 through a fixed orifice hole 330 that is formed toward the suction chamber 310 through the wall surface of the rear housing 300 on the second passage. In this case, the fixed orifice hole 330 may be disposed in a direction oblique to the longitudinal direction of the drive shaft 230.

As illustrated in FIG. 3, a fixed orifice hole 330' may also be disposed in a direction perpendicular to the longitudinal direction of the drive shaft 230.

As described above, in order to minimize the loss of control gas that may be caused by providing the fixed orifice in the valve assembly 600, the passage (second passage) in which the high-pressure gas in the discharge chamber 320 flows to the crank chamber 250 through the control valve in the rear housing 300 and the passage leading to the suction chamber 310 from the crank chamber 250 are provided as a single passage.

Thus, the existing fixed orifice formed in the valve assembly 600 may be eliminated, or may be shifted to the rear housing 300 or the control valve to be described later, as illustrated in FIGS. 2 and 3, to minimize the loss of control gas.

Forming the orifice hole 330 or 330' in the rear housing 300 is advantageous in that the size of the orifice hole is further reduced compared to when the orifice hole is formed in the valve assembly 600. In addition, the discharge chamber-crank chamber communication hole and the crank chamber-suction chamber communication hole formed in the rear housing 300 may be provided as a single communication hole and a separate valve body may be provided to vary the size of the orifice.

In the swash plate compressor according to the embodiment of the present disclosure having the above configuration, an operation state of a control valve according to each stroke and thus a passage for refrigerant gas will be described in detail.

Figure 4:
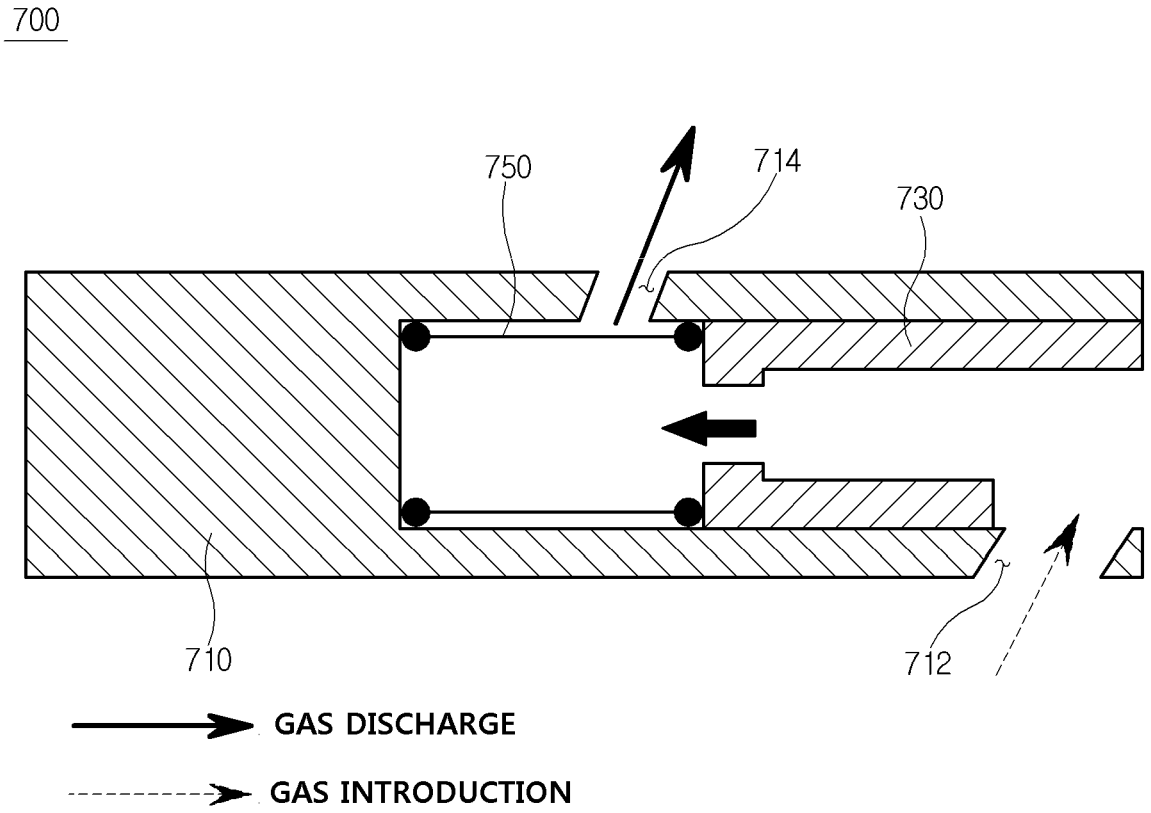
FIG. 4 is a schematic view illustrating a maximum stroke of a control valve in the variable capacity compressor according to the present disclosure.
Figure 5:
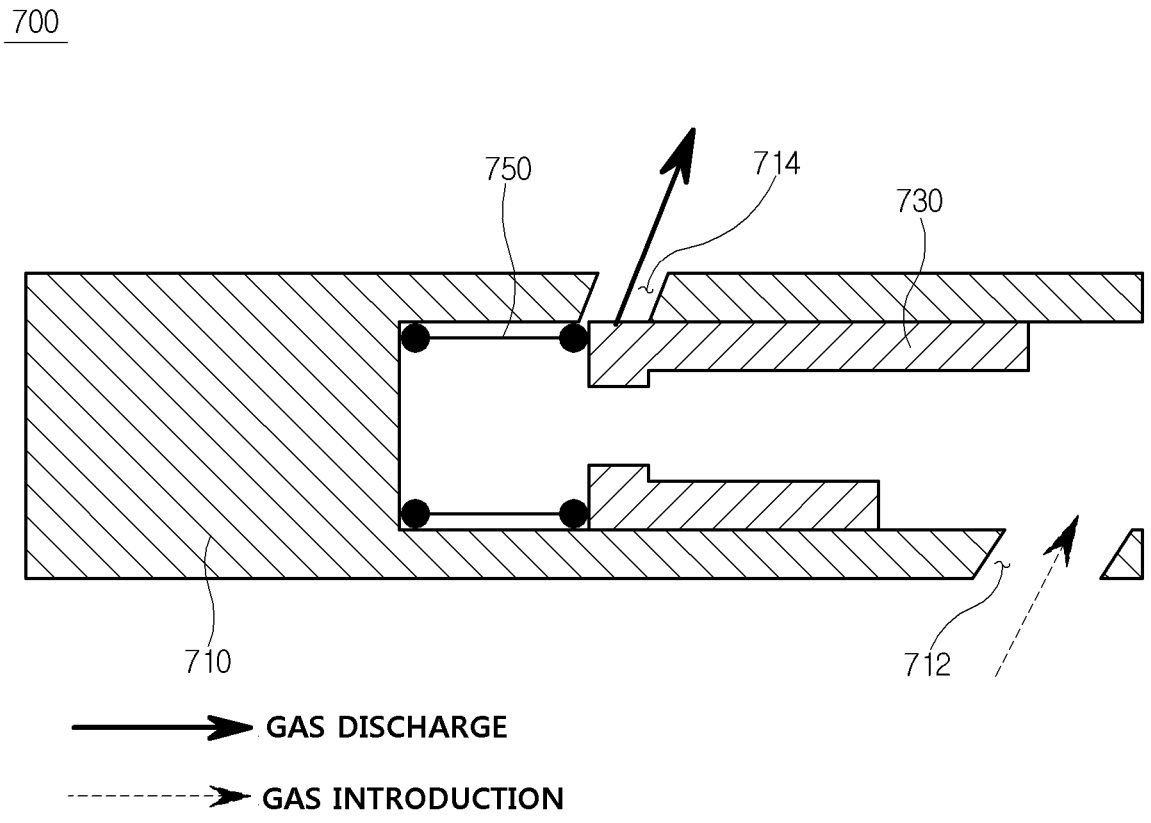
FIG. 5 is a schematic view illustrating a variable stroke of the control valve in the variable capacity compressor according to the present disclosure.

FIG. 4 is a schematic view illustrating a maximum stroke of the control valve in the variable capacity compressor according to the present disclosure. FIG. 5 is a schematic view illustrating a variable stroke of the control valve in the variable capacity compressor according to the present disclosure.

As illustrated in FIGS. 4 and 5, the control valve 700 includes an inlet 712 formed through one longitudinal surface of a valve housing 710 for introduction of refrigerant gas, and a variable orifice 714 formed on the other surface of the valve housing 710 opposite to the inlet 712. A valve reed 730 is accommodated in the valve housing 710, and one longitudinal end of the valve reed 730 is elastically supported by a spring 750. One longitudinal side of the valve reed 730 corresponding to the direction of the inlet 712 is opened to introduce the refrigerant gas. A hole is formed in one end of the valve reed 730 toward the spring so that the refrigerant gas can pass therethrough, and the gas having passed through the valve reed 730 flows out into the variable orifice 714.

Although the variable orifice 714 itself formed through the valve housing 710 is a hole, the size of which is fixed, it is defined as a variable orifice since the opening degree of the variable orifice 714 is changed by the valve reed 730.

As illustrated in FIG. 4, in the maximum stroke at which the angle of inclination of the swash plate 500 is maximum, the introduction of the refrigerant gas from the discharge chamber 320 is blocked (a detailed embodiment of the control valve will be described later), and the refrigerant gas is introduced into the control valve 700 from the crank chamber 250. Since the restoring force of the spring 750 is set to be larger than the pressure of the control gas, the valve reed 730 is pushed by the restoring force of the spring 750 to open the variable orifice 714. The refrigerant gas introduced through the inlet 712 of the valve housing 710 is then introduced into the opening of the valve reed 730. The introduced refrigerant gas flows in the direction Ps of the suction chamber 310 through the variable orifice 714.

As illustrated in FIG. 5, in the variable stroke at which the angle of inclination of the swash plate 500 is reduced, the refrigerant gas is introduced from the discharge chamber (a detailed embodiment of the control valve will be described later) so that the control gas has a pressure larger than the spring 750. Thus, the valve reed 730 presses the spring 750 to block a portion of the variable orifice 714. Therefore, the refrigerant gas introduced through the inlet 712 of the valve housing 710 is discharged to the variable orifice 714 in a significantly reduced amount even though it passes through the valve reed 730. In this manner, the size of the variable orifice 714 formed on the valve housing 710 is variable.

Hereinafter, the detailed configuration and operation relationship of the control valve according to the flow of the refrigerant gas will be described in detail. Although the control valve will be described as being a ball-type valve for convenience, this is merely an example and is not intended to limit the present disclosure.

Figure 6:
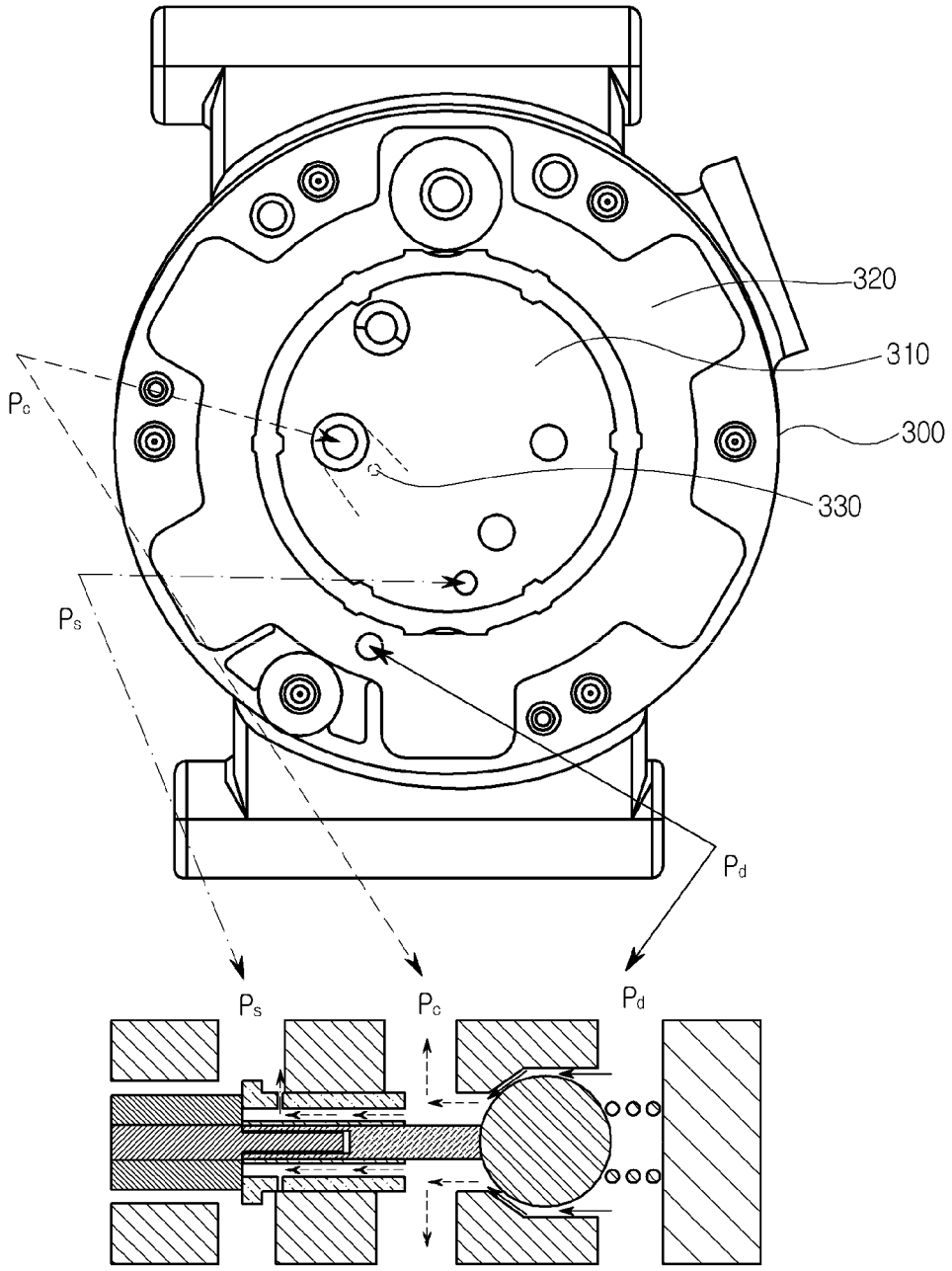
FIG. 6 is a top view illustrating a Pc-Pd-Ps passage in the variable capacity compressor of FIGS. 2 and 3.
Figure 7:
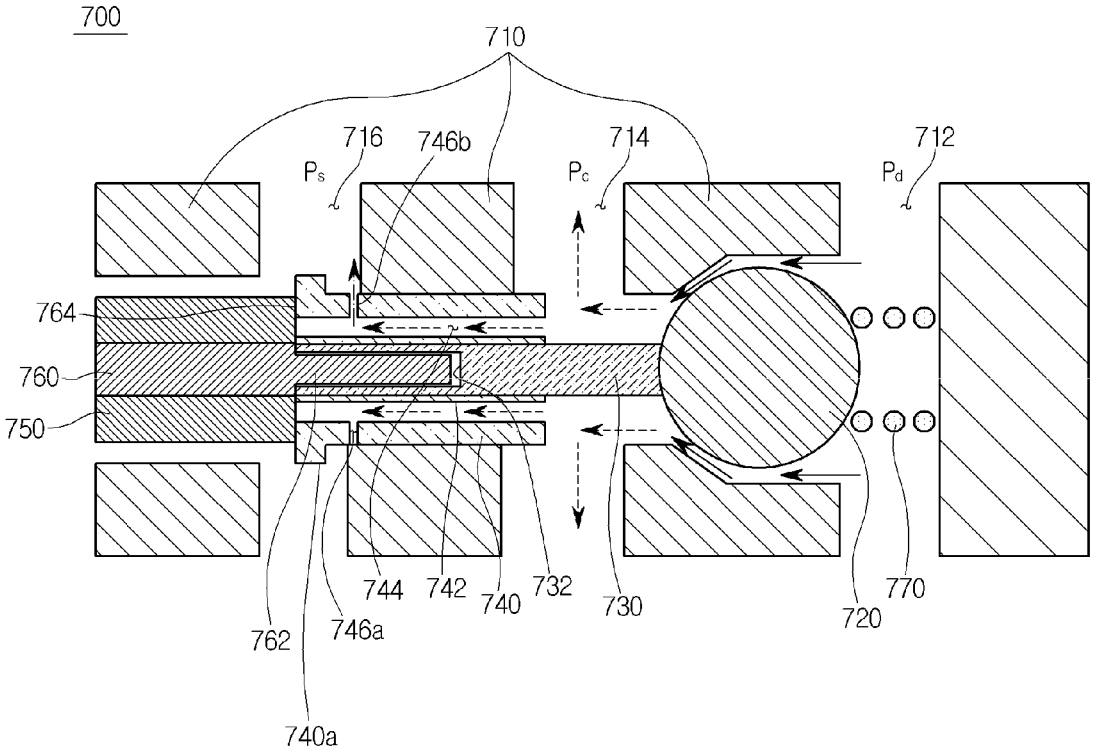
FIG. 7 is a schematic view illustrating a detailed operation state of a control valve in a control-off mode for a variable capacity compressor according to another embodiment of the present disclosure.

FIG. 6 is a top view illustrating a Pc-Pd-Ps passage in the variable capacity compressor of FIGS. 2 and 3. FIG. 7 is a schematic view illustrating a detailed operation state of a control valve in a control-off mode for a variable capacity compressor according to another embodiment of the present disclosure.

In the rear housing 300, the communication hole Pd-Pc allowing the discharge chamber 320 to communicate with the crank chamber 250 and the communication hole Pc-Ps allowing the crank chamber 250 to communicate with the suction chamber 310 may be provided as a single common communication hole 350.

In more detail, the first passage allows a first hole 712 to communicate with a second hole 714 and the second passage allows the second hole 714 to communicate with a third hole 716 in the valve housing 710. When the angle of inclination of the swash plate 500 is decreased to minimize the movement distance of the piston 112 (first condition), the first passage is fully opened and the second passage is partially opened. When the angle of inclination of the swash plate 500 is increased to maximize the movement distance of the piston 112 (second condition), the first passage is fully closed and the second passage is fully opened. In the above third condition, the first passage may be partially opened and the second passage may be opened to a degree that is larger than the partial opening and smaller than the full opening.

In the control-off mode in which the angle of inclination of the swash plate 500 is not varied, the refrigerant gas is introduced into the rear housing 300 through the communication hole, and flows to the crank chamber 250 (see FIG. 1) through the valve assembly 600 (in the direction of the dotted arrow). In this case, the fixed orifice hole of the rear housing 300 may be eliminated, and the refrigerant gas may be introduced into the suction chamber 310 only through the variable orifice 714 formed in the control valve 700.

The rear housing 300 is formed with a hole in communication with each hole of the control valve 700. For convenience, the crank chamber direction is represented by Pc, the suction chamber direction is represented by Ps, and the discharge chamber direction is represented by Pd, and each direction hole formed in the control valve 700 corresponds to each hole of the rear housing 300 as in FIG. 6.

The ball-type control valve 700 may have a structure as illustrated in FIG. 7.

The control valve 700 may first include a valve housing 710. The valve housing 710 may have a first hole 712 through which the control gas is introduced in the discharge chamber direction Pd, a second hole 714 through which the control gas passes in the crank chamber direction Pc, and a third hole 716 through which the control gas is discharged in the suction chamber direction Ps.

A spherical valve head 720 is inserted into the valve housing 710, and the portion of the valve housing 710 into which the valve head 720 is inserted has an inner peripheral surface that is selectively operable and closable by the valve head 720. The valve head 720 is elastically supported by a spring 770. A valve reed 730 protrudes and extends from the one side of the valve head 720, and the valve reed 730 has a recessed groove 732 formed therein.

A reed housing 740 surrounds the outer peripheral surface of the valve reed 730 and a reed passage 744 for the pass of the control gas is longitudinally formed between the outer wall of the reed housing 740 and a support 742 that is in contact with and supported by the valve reed 730. The reed housing 740 has a protrusion 740 *a* protruding outward from an end opposite to the valve head 720 from among the longitudinal ends of the reed housing 740. A first orifice hole 746 *a* and a second orifice hole 746 *b* are formed in the outer wall spaced apart from the protrusion 740 *a*. In FIG. 7, the first and second orifice holes 746 *a* and 746 *b* face each other but are not disposed on a straight line.

The reed housing 740 includes a first reed block 750 and a second reed block 760 formed at the ends thereof. The second reed block 760 is inserted into the first reed block 750, and a reed insert 762 inserted into the recessed groove 732 of the valve reed 730 protrudes from one end of the second reed block 760.

FIG. 7 illustrates the flow of control gas in the control valve 700 when the control-off mode or the second condition in which the angle of inclination of the swash plate 500 is not varied is changed to the first condition, in which case the control gas passes between the valve head 720 and the valve housing 710 when it is introduced into the control valve 700 in the direction Pd of the discharge chamber 320 (indicated by the solid line). Some of the control gas is discharged in the crank chamber direction Pc and some is introduced into the reed passage 744 of the reed housing 740.

In this case, the first orifice hold 746*a* is closed by the valve housing 710 and the second orifice hole 746*b* is opened. Thus, the control gas is introduced in the direction Ps of the suction chamber 310 only through the second orifice hole 746*b*. Since some of the control gas is supplied in the crank chamber direction Pc rather than the direction Ps of the suction chamber 310, the amount of the refrigerant gas flowing out in the direction Ps of the suction chamber 310 may be minimized.

Here, the first orifice hole 746 *a* is opened or closed according to the movement of the reed housing 740 by the valve reed 730, and the second orifice hole 746 *b* may be defined as a fixed orifice hole. The first orifice hole 746 *a* may be defined as a variable orifice hole.

Figure 8:
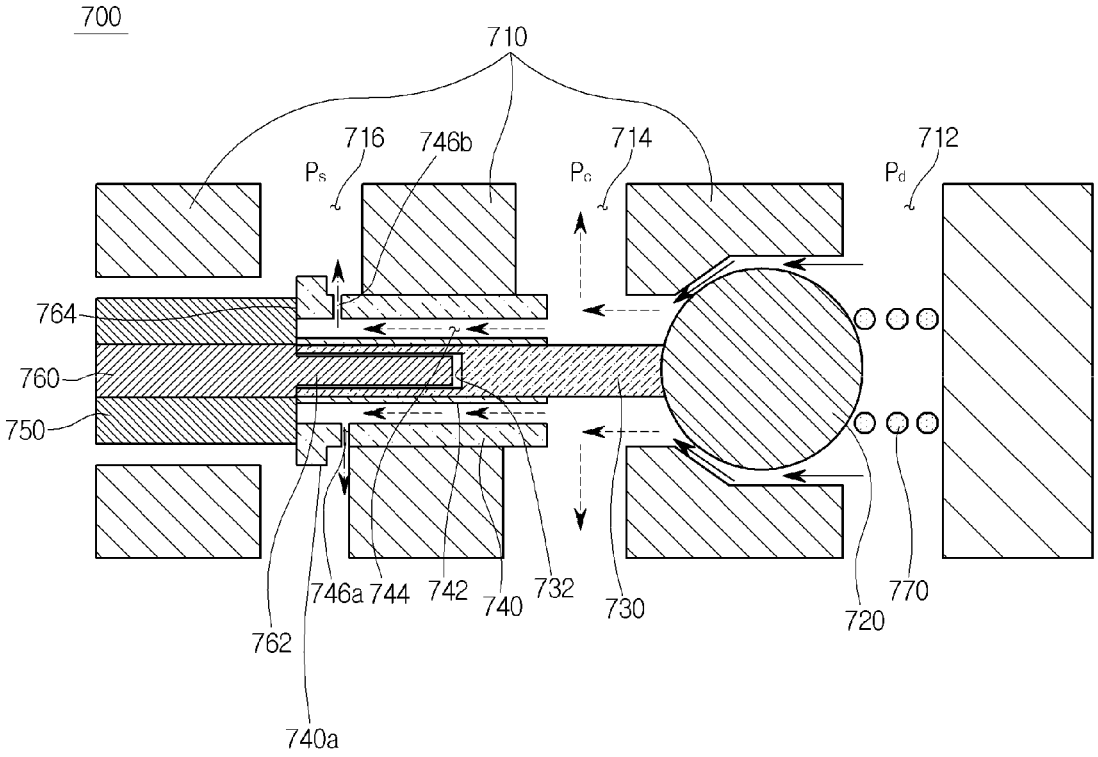
FIG. 8 is a schematic view illustrating a detailed operation state of a control valve in a variable mode for the variable capacity compressor of FIG. 7.

FIG. 8 is a schematic view illustrating a detailed operation state of a control valve in a variable mode for the variable capacity compressor of FIG. 7.

In the variable mode in which the angle of inclination of the swash plate 500 is varied (third condition), the refrigerant gas flows in the same path as FIG. 6.

Referring to FIG. 8, as the amount of the control gas discharged from the direction Pd of the discharge chamber 320 increases, the valve reed 730 moves further toward the first reed block 750 and the second reed block 760 and the gap between the valve head 720 and the inner peripheral surface of the valve housing 710 is small. As the valve head 720 moves, the valve reed 730 and the reed housing 740 are pushed to the left in FIG. 9 so that the first orifice hole 746*a* is opened together with the second orifice hole 746*b*. Thus, the control gas is supplied in the crank chamber direction Pc and in the direction Ps of the suction chamber 310, and the amount of the control gas supplied in the direction Ps of the suction chamber 310 increases.

Figure 9:
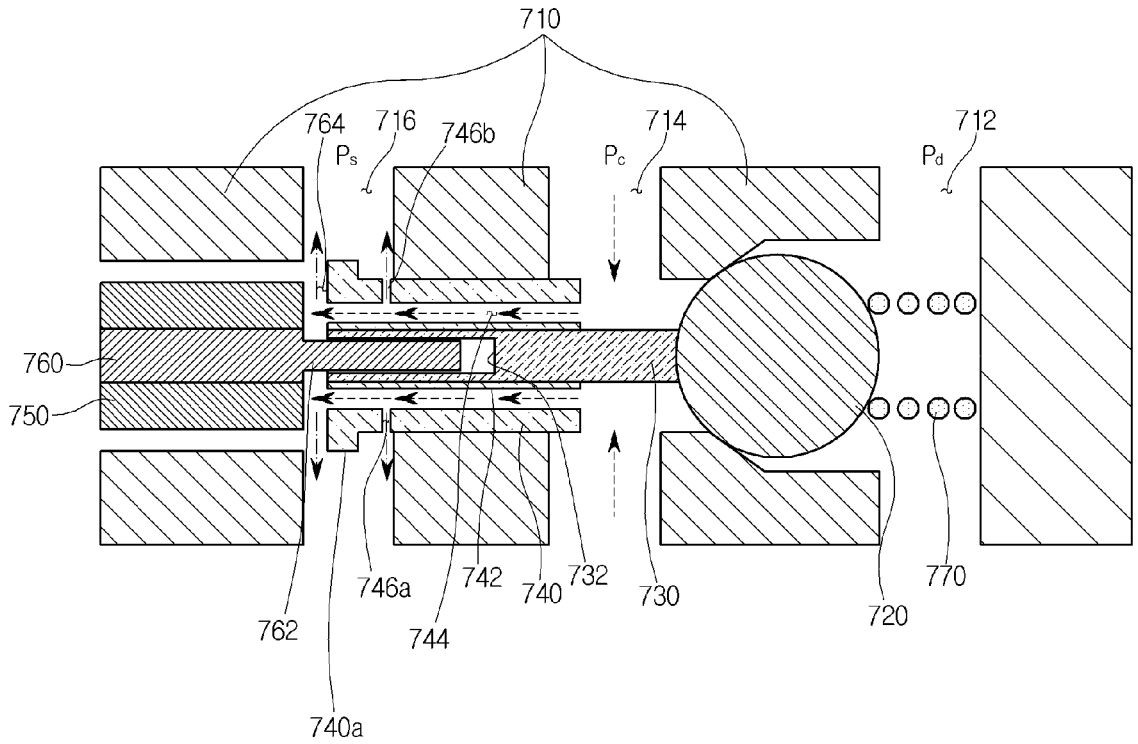
FIG. 9 is a schematic view illustrating a detailed operation state of a control valve in a maximum movement mode for the variable capacity compressor of FIG. 7.

FIG. 9 is a schematic view illustrating a detailed operation state of a control valve in a maximum movement mode for the variable capacity compressor of FIG. 7.

In the maximum movement mode in which the angle of inclination of the swash plate 500 is maximum, the refrigerant gas flows from the crank chamber 250 to the suction chamber 310 along the dotted direction.

In this case, as illustrated in FIG. 9, since the valve head 720 is pressed by the pressure of the refrigerant gas introduced into the control valve 700 from the direction Pd of the discharge chamber 320 and the valve head 720 is blocked by the inner peripheral surface of the valve housing 710, the control gas does not pass through the valve head 720.

At the same time, the control gas is introduced through the second hole 714 from the crank chamber direction Pc, and the first reed block 750 and the second reed block 760 are pushed as much as possible by the control gas having passed through the reed housing 740. When the first reed block 750 and the second reed block 760 are pushed to the left in FIG. 9, the gap between the lead housing 740 and the first and second reed blocks 750 and 760 is opened. The corresponding gap may be defined as a third orifice hole 764. When the second orifice hole 746*b*, which is a fixed orifice hole, is opened, the first orifice hole 746*a*, which is a variable orifice hole, is opened, and the third orifice hole 764 is additionally opened, the amount of the refrigerant gas discharged in the direction Ps of the suction chamber 310 becomes maximum.

According to the present disclosure, it is possible to reduce the loss of control gas by eliminating the fixed orifice hole formed in the existing valve assembly and forming it in the control valve or the passage connecting the control valve and the crank chamber. In this case, forming the fixed orifice hole in the control valve is advantageous in that the size of the fixed orifice hole is variable (which is possible by selectively opening and closing a plurality of holes) depending on the operation of the compressor. On the other hand, forming the fixed orifice hole in the passage connecting the control valve and the crank chamber causes the loss of control gas to be reduced because the fixed orifice hole can be machined to a smaller size compared to the existing orifice hole, the minimum size of which is limited due to difficulty of machining.

The exemplary embodiments of the present disclosure described above and illustrated in the drawings should not be construed as limiting the technical idea of the disclosure. It will be apparent to those skilled in the art that the scope of the present disclosure is limited only by the appended claims and various variations and modifications may be made without departing from the spirit and scope of the disclosure. Therefore, these variations and modifications will fall within the scope of the present disclosure as long as they are apparent to those skilled in the art.

INDUSTRIAL APPLICABILITY

The present disclosure provides a control valve and a variable capacity compressor which are capable of preventing an unnecessary loss of control gas to improve efficiency of the compressor.

What is claimed:

1. A control valve to adjust an angle of a swash plate of a variable capacity compressor, the control valve comprising:

a valve housing having a first hole in communication with a discharge chamber of the compressor, a second hole in communication with a crank chamber, and a third hole in communication with a suction chamber;

a first passage allowing the first hole to communicate with the second hole and a second passage allowing the second hole to communicate with the third hole in the valve housing;

a first switching means for opening and closing the first passage; and a second switching means for opening and closing the second passage, wherein the first passage is fully opened and the second passage is partially opened in a first condition in which an angle of inclination of the swash plate is decreased to minimize a movement distance of a piston, and the first passage is fully closed and the second passage is fully opened in a second condition in which the angle of inclination of the swash plate is increased to maximize the movement distance of the piston, wherein in a third condition in which the angle of the swash olate is adjusted so that the movement distance of the piston corresponds between the first condition and the second condition, the first passage is partially opened to form a partial opening and the second passage is opened to a degree that is larger than the partial opening and smaller than the full opening of the first passage, wherein the second switching means comprises a first orifice hole a second orifice hole and a third orifice hole for opening and closing the second passage, and in the first condition, the second orifice hole opens the second passage, and the first orifice hole and the third orifice hole close the second passage, wherein in the second condition, the first to third orifice holes open the second passage, and wherein in the third condition, the first and second orifice holes open the second passage, and the third orifice hole closes the second passage.

2. The control valve according to claim 1, wherein the second switching means opens a flow area of the second passage larger in the order of the first condition<the third condition<the second condition.

3. The control valve according to claim 1, wherein the first switching means is a ball valve that comes into contact with or is separated from the valve housing between the first hole and the second hole to open and close the first passage.

4. A variable capacity compressor comprising:

the control valve according to claim 1;

the crank chamber having the swash plate disposed therein;

a cylinder bore in which the piston reciprocates to compress a refrigerant; and a valve assembly configured to suck or discharge the refrigerant into or from the cylinder bore, wherein the valve assembly comprises:

a valve plate comprising the following elements: a suction hole for circulation of the refrigerant sucked thereinto, a discharge hole for circulation of the refrigerant discharged therefrom, and first to third circulation holes for connecting the control valve to the suction chamber, the discharge chamber, and the crank chamber;

a suction reed disposed on one surface of the valve plate to open and close the suction hole; and a discharge reed disposed on the other surface of the valve plate to open and close the discharge hole.

5. A variable capacity compressor comprising:

the control valve according to claim 1;

the crank chamber having the swash plate disposed therein;

a cylinder bore in which the piston reciprocates to compress a refrigerant; and a valve assembly configured to suck or discharge the refrigerant into or from the cylinder bore, wherein the valve assembly comprises:

a valve plate comprising the following elements: a suction hole for circulation of the refrigerant sucked thereinto, a discharge hole for circulation of the refrigerant discharged therefrom, first to third circulation holes for connecting the control valve to the suction chamber, the discharge chamber, and the crank chamber, and an assembly hole for housing fastening;

a suction reed disposed on one surface of the valve plate to open and close the suction hole; and a discharge reed disposed on the other surface of the valve plate to open and close the discharge hole.

6. A variable capacity compressor comprising:

the control valve according to claim 1;

the crank chamber having the swash plate disposed therein;

a cylinder bore in which the piston reciprocates to compress a refrigerant; and a valve assembly configured to suck or discharge the refrigerant into or from the cylinder bore, wherein the valve assembly comprises:

a valve plate comprising the following elements: a suction hole for circulation of the refrigerant sucked thereinto, a discharge hole for circulation of the refrigerant discharged therefrom, first to third circulation holes for connecting the control valve to the suction chamber, the discharge chamber, and the crank chamber, an assembly hole for housing fastening, and a coupling hole for coupling a discharge reed;

a suction reed disposed on one surface of the valve plate to open and close the suction hole; and the discharge reed disposed on the other surface of the valve plate to open and close the discharge hole.

7. A variable capacity compressor comprising:

the control valve according to claim 1;

the crank chamber having the swash plate disposed therein;

a cylinder bore in which the piston reciprocates to compress a refrigerant; and a valve assembly configured to suck or discharge the refrigerant into or from the cylinder bore.

8. The control valve according to claim 1, wherein the first switching means is a ball valve.

* * * * *